US006654704B2

(12) United States Patent
Wager et al.

(10) Patent No.: US 6,654,704 B2
(45) Date of Patent: Nov. 25, 2003

(54) EXPLOSIVE SAFETY SITING METHOD

(75) Inventors: Phillip C. Wager, Port Hueneme, CA (US); Frank R. Johnson, Oxnard, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 5 days.

(21) Appl. No.: 10/145,624

(22) Filed: May 9, 2002

(65) Prior Publication Data

US 2003/0033114 A1 Feb. 13, 2003

Related U.S. Application Data

(60) Provisional application No. 60/292,326, filed on May 22, 2001.

(51) Int. Cl.[7] ..... G06F 15/00
(52) U.S. Cl. ..... 702/158
(58) Field of Search ..... 102/205, 303; 299/30; 700/104; 702/5, 155, 158; 73/167

(56) References Cited

PUBLICATIONS

Fertal, M; Leone, K;"Applications of Blast/FX, An Expolsive Effects Analysis Software Tool";Proceedings IEEE 34th Annual 2000 International Carnahan Conference On Security Technology; Oct. 23–25, 2000; pp 218–221.*
Barche, M jr.; Rieder, W;"Automated Explosive Site Planner: A Software System for Siting Explosives"; Proceedings of the National Aerospace And Electronics Conference; May 20–24, 1991; vol 3; pp 1260–1266.*

* cited by examiner

*Primary Examiner*—John Barlow
*Assistant Examiner*—Douglas N Washburn
(74) *Attorney, Agent, or Firm*—David S. Kalmbaugh

(57) ABSTRACT

A method for making a determination of a required separation distance between each of a plurality of potential explosive sites and its associated exposed site. When an actual separation distance is less than the required separation distance mitigation procedures or options are available to resolve a separation distance violation between a potential explosive site and an exposed site.

8 Claims, 2 Drawing Sheets

EXPLOSIVE SAFETY SITING METHOD

This application claims the benefit of U.S. Provisional Application No. 60/292,326, filed May 22, 2001

BACKGROUND OF THE INVENTION

1. Field of the Invention

This invention relates generally to a method for locating and characterizing potential explosive sites at an installation or at a forward logistics area. More particularly, this invention relates to a method for determining an actual separation distance between each potential explosive site and an associated exposed site. Further, this invention relates to a method for determining a required separation distance between each potential explosive site and their associated exposed site.

2. Description of the Prior Art

In the past, there has not been a uniform set of criteria developed to effectively characterize potential explosive sites at a military installation, or at a forward logistics area. Without proper identification of these potential explosive sites, military and civilian personnel can be severely injured which may result in loss of life. Property damage can also be significant to nearby buildings and other facilities should an explosion occur at potential explosive sites which has not been accurately characterized.

Currently policy, regulations, and criteria developed and maintained by the Department of Defense with respect to the characterization of potential explosive sites are not completely automated. There have been efforts to automate subsets of documents relating to potential explosive sites at military installations. Installation maps and their associated data characterizing the facilities have been used with some automated siting applications. However, this usage employs a copy of installation data instead of using the data directly by fully integrating the data with the installation data. The copy of installation data has a high probability of being out dated which leads to serious errors often causing harm to property and injury and even death to individuals.

Site plans can be created for an installation which will identify potential explosive sites, but the site maps generally will conform with only a subset of the installation master plan. Explosion effects are not quantified. There is currently not available an existing application which creates and manages the administrative documents associated with an installation explosives safety program.

SUMMARY OF THE INVENTION

The present invention overcomes some of the difficulties of the past, including those mention above in that it comprises a method for creating and managing the administrative documents associated with a comprehensive, effective and highly efficient explosives safety program. In addition, the method of the present invention provides for a determination of the actual separation distance between each potential explosive site and an associated exposed site. Further, the method of the present invention provides for a determination of the required separation distance between each potential explosive site and its associated exposed site. When the actual separation distance is less than the required separation distance mitigation procedures or options are available to resolve a separation distance violation between a potential explosive site and an exposed site. The mitigation options available for the method of the present invention include: (1) a reduction in explosive material storage capacity for the potential explosive site; (2) a mitigation project for the potential explosive site; and (3) an engineering analysis of the potential explosive site. After a mitigation option is selected and completed the explosive safety siting method proceeds to determine the required PES-ES separation distance. When the actual separation distance is greater than the required separation distance for a potential explosive site-exposed site pair, the method proceeds to a step by which a site plan manager manages site plans to insure that required distances with respect to each PES-ES are maintained and thus safety standards are met.

DETAILED DESCRIPTION OF THE PREFERRED EMBODIMENT

Figure 1:
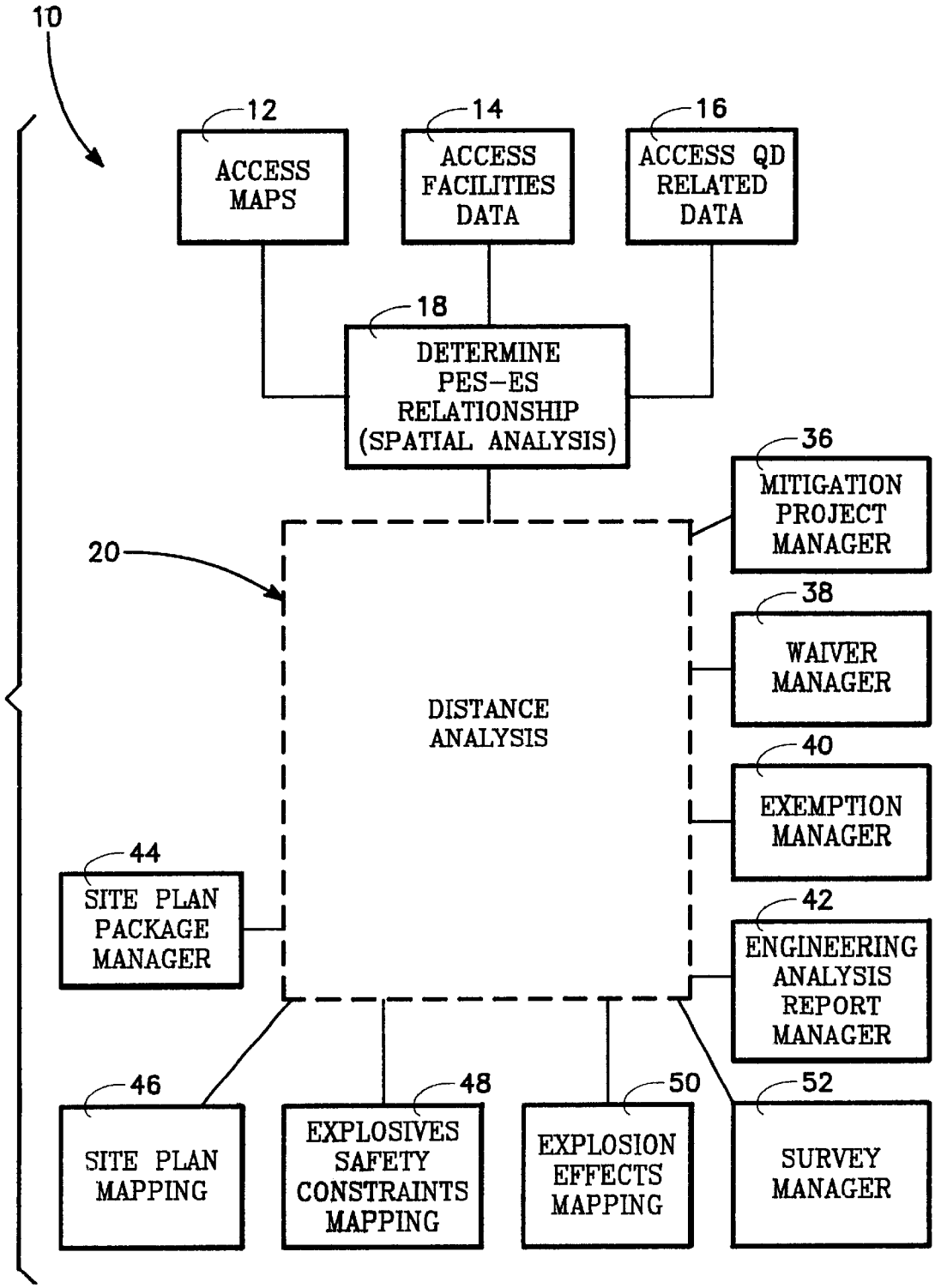
FIG. 1 is a flow diagram illustrating the steps of a method for creating and managing the administrative documents associated with a comprehensive explosives safety program.

Referring to FIG. 1, there is shown a flow diagram for an explosive safety siting method (designated generally by the reference numeral 10) for making a determination of the actual separation distance between each potential explosive site at an installation and an associated exposed site at the installation. Further the method illustrated in the flow diagram of FIG. 1 depicts how a determination is made as to the required separation distance between each potential explosive site and their associated exposed site.

Step 12 of the explosive safety siting method 10 relates to access maps which provide installation data for a particular facility or installation. Step 12 of explosive safety siting method 10 associates explosive safety siting method 10 with an installation data repository consisting of maps and facilities characteristics for the installation. Explosive safety siting method 10, in turn, relies upon industry standard data access methods that permit access to mapping data stored in any of a variety of common formats such as AutoCAD, MircroStation, ArcInfo, ArcView, MGE and GeoMedia with associated data also being stored in a variety of formats such as Microsoft Access, Oracle and SQL-Server. In particular, a subset of the installation real property inventory (RPI) data elements is provided in the installation data repository which includes a facility identifier, a facility description, and a Department of Defense (DoD) facility construction category code.

Steps 14 of the explosive safety siting method 10 extends facilities properties data to additional data elements that are required by standard Department of Defense, i.e. Army, Marine Corps, Navy, and Air Force quantity-distance (QD) analysis criteria. For example, an earth-covered magazine which has a 422 category code is distinguishable by the strength of its head wall (i.e. 7-bar, 3-bar or undefined). Furthermore, the fact that it is an earth-covered magazine is essential data, since an above-ground magazine or an open storage module also uses a 422 category code as an identifier. The additional data elements provided by step 14 of method 10 are generated using the data from step 12 of method 10, an RPI QD (real property inventory quantity-distance) Data Tool, an Ammunition and Explosives Data Tool, and a Front Identification Tool. These tools which are database preparation application tools are separate and distinct from the explosive safety siting method 10.

Step 16 of method 10 which relates to access of QD related data which includes building criteria data. Building criteria data including building title, construction categories, building dimensions, building coordinates and building orientation as well as large building data and component data.

Step 36 of explosive safety siting method 10 sets forth the Mitigation Project Manager as the software component who manages data associated with mitigation projects which are typically construction projects. The mitigation projects are, in turn, associated with either a potential explosive site (PES) at an installation and/or an exposed site (ES) at the installation that when complete will mitigate a quantity-distance criteria violation.

Step 38 of explosive safety siting method 10 sets forth the Waiver Manager as the component that manages data associated with quantity-distance criteria waivers. A waiver is written authority to temporarily deviate from a mandatory requirement of the quantity-distance criteria for strategic or other compelling reasons. Waivers are not granted for periods exceeding five years. Waivers are reviewed at intervals that do not exceed two years and can be granted for a time period of one year.

Step 40 of explosive safety siting method 10 sets forth the Exemption Manager as the component that manages data associated with quantity-distance criteria exemptions. An exemption is written authority permitting long term, usually more then five years, noncompliance with quantity-distance criteria. Exemptions are reviewed at intervals that do not exceed five years.

Step 42 of explosive safety siting method 10 sets forth the Engineering Analysis Report Manager as the component that manages bibliographic data associated with reports of engineering analysis results. Reports on three types of engineering analyses are common: (1) explosion confinement analysis of a potential explosive site; (2) debris analysis for an exploding potential explosive site; and (3) a protection analysis to determine if an exposed site can withstand blast pressure and debris hazards imposed upon it by an exploding PES. Additionally, separation distance, which mitigates violations between potential explosive site (PES)-exposed site (ES) pairs considered in the method 10 analysis, is included with the bibliographic data.

Step 52 of explosive safety siting method 10 sets forth the Survey Manager as the component that manages data collected during surveys which are conducted by explosive safety experts. This data collected during these surveys provides guidance that will improve the explosives safety program at an installation. The surveys are usually conducted every two years. The actions required in previous surveys are reviewed in current surveys to evaluate compliance with the explosive safety program.

During step 18 of explosive safety siting method 10 spatial analysis is performed to identify potential explosive site (PES)-exposed site (ES) pairs at an installation. Additional information necessary for a quantity-distance analysis is also derived from this spatial analysis (e.g. actual separation distance, PES-ES facing relationships). Polygons and polyline graphic tools are required and used for a spatial analysis. Measuring criteria specified in the appropriate quantity-distance criteria is used in performing the analysis. Geometric algorithms are employed to determine the minimum distance between each potential explosive site (PES) and an associated exposed site (ES). Templates are also utilized to define facilities, areas or conveyances to facilitate accurate measurement computations relating to each potential explosive site (PES)-exposed site (ES) pair at an installation.

Step 44 of explosive safety siting method 10 sets forth the Site Plan Package Manager as the component that creates and manages site plan packages for an installation that are being submitted for approval by an approving authority. The site plan package includes a cover letter, one or more site plans and other enclosures necessary to substantiate the request for approval of the site plan package. The site plan manager is cognizant of the state of the site plan package, for example, the plan is in the draft stage, the plan is being proposed at the local level, the plan is being submitted for approval, the plan is approved, or the plan is archived. Correspondence associated with the approval is included in a site plan management document.

During step 46 of explosive safety siting method 10 a site plan mapping process prepares site plan map overlays for a master installation map. Each site plan in a collection of overlays is defined with respect to a unique potential explosive site (PES) at an installation. Quantity-distance (QD) arcs associated with each site plan, selected site plans, or all site plans can be displayed using the overlays. Selection tools are provided which allow various options for distinguishing arcs and their associated potential explosive site (PES), exposed site (ES), or an encumbered area at the installation. Arc geometry tools that permit graphic editing (for example, trimming a line, deleting a line) or annotations (for example, dimensions and notes) are included in the master installation map. These tools are also include quantity-distance (QD) functions that do not require quantity-distance (QD) analysis as defined in step 20 of explosive safety siting method 10. The tools produce inhabited building, public transportation, intramaline, or intermagazine arcs for selected or all potential explosive sites (PESs).

During step 48 of explosive safety siting method 10, an Explosives Safety Constraint Mapping process joins together an entire set of site plan arcs to define an explosives safety constraint for the installation master planning functions. The Explosive Safety Constraint Mapping process includes a function to union the set of site plan arcs. The explosive safety constraint and its properties are integrated with the installation facilities management system.

During step 48 of explosive safety siting method 10, an Explosion Effects Mapping process displays the effects of an explosion at a selected potential explosive site (PES). The computed effects of the blast, which are computed using conventional and well known algorithms, include blast pressure with respect to distance from the potential explosive site, potential explosive site debris distribution around the explosive site, people in the open in the vicinity of a potential explosive site, and occupied buildings in the vicinity of a potential explosive site.

Blast pressure at distances radiating from a potential explosive site is displayed a contours surrounding the potential explosive site. The furthermost contour boundary is associated with glass breakage at the distance which is representative of the furthermost contour boundary.

The debris throw from the potential explosive site damaged structure is analyzed to determine the number of fragments in 600 square foot cells surrounding the structure. The resulting fragment distribution is displayed as contours. The furthermost contour boundary is associated with one fragment within 600 square feet.

The injury level which may be, for example, severe, heavy, moderate, minor or minimal expected for people in an open area adjacent the potential explosive site is also computed. The injury levels are presented as contours around the potential explosive site.

Building damage associated with buildings surrounding the potential explosive site is also computed. The information relating to building damage is reported for each selected building around the potential explosive site. The information relating to building damage includes an assessment of the damage and repair associated with the building, glass breakage, and the injury level associated with the occupants.

Figure 2:
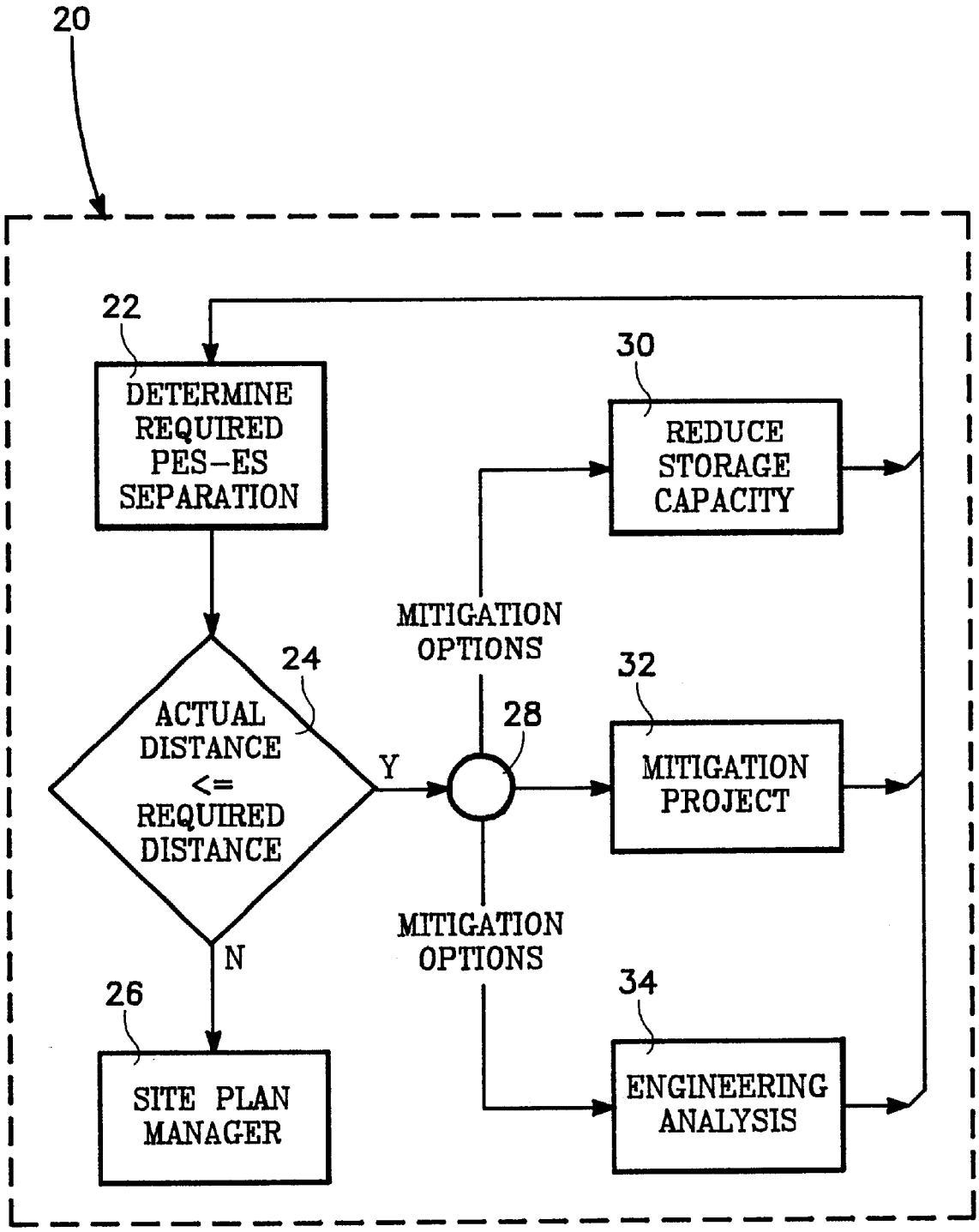
FIG. 2 is a flow diagram illustrating the steps associated with the distance analysis step of FIG. 1.

Referring now to FIGS. 1 and 2, FIG. 2 depicts in detail the site planning procedure (step 20) including mitigation options. The site plan includes all associated exposed sites (ESs) forming a set of potential explosive site-exposed site pairs. Each set of potential explosive site-exposed site pairs has certain properties derived from the potential explosive site and exposed site independent facility properties, spatial analysis, and quantity-distance analysis. The site plan documentation includes a table showing each potential explosive site-exposed site (PES-ES) pair with a subset of their properties including at a minimum the following (1) the net explosives weight (NEW) for each hazard division; (2) the actual separation distance (derived from spatial analysis in step 18 of explosive safety siting method 10) between the PES-ES pair; (3) the required separation distance (derived from quantity-distance analysis in step 18 of explosive safety siting method 10); (4) and a drawing of the explosive site relative to its associated exposed site.

When the actual separation distance is less than the required separation distance (step 24 of the explosive safety siting method 10) mitigation procedures or options (step 28 of method 10) are available to resolve the separation distance violation. The mitigation options available for step 28 of program 10 include (1) a reduction in storage capacity of the potential explosive site (step 30 of method 10); (2) mitigation project for the potential explosive site (step 32 of method 10); and (3) engineering analysis of the potential exposed site (step 34 of method 10). A mitigation project may be the construction of a concrete containment wall around the explosive site of sufficient thickness to prevent blast pressure and debris hazards generated by an explosion at the explosive site from damaging a nearby building or like structure.

After a mitigation option is selected and completed the explosive safety siting method 10 determines the required PES-ES separation distance (step 22 of method 10). When the actual separation distance is greater than the required separation distance for a potential explosive site-exposed site pair, the method proceeds to step 26 by which the site plan manager manages site plans to insure that required distances with respect to each PES-ES are maintained and thus safety standards are met.

At this time it should be noted that a computer with software may be used for determining a required separation distance between an explosive site and its associated exposed site to prevent damage to the associated exposed site when an explosion occurs at the explosive site.

An exposed site (ES) based site plan can then be prepared for an installation using one or more potential explosive site (PES) based site plans.

The spatial analysis required in step 18 of method 10 may be performed using a set of commercially available integrated algorithms. Geometric templates including polygons and/or polylines define each entity including its related properties to be analyzed during step 18 of method 10. A building template, for example, may be a simple rectangle or a more complex "L" or "H" shaped polygon. A circular exposed site (ES) selection zone is used to exclude facilities that are located outside the area of exposure of a potential explosion. This exclusion reduces the quantity-distance (QD) computation requirement to only those sites that are exposed to a potential explosive site (PES). The facing relationship (e.g. the exposed site is to the right of the potential explosive site and its left side faces the potential explosive site) of an PES-ES pair is also defined in step 18 of method 10. Finally, step 18 of method 10 defines the actual minimum separation distance between the PES-ES pair using quantity distance (QD) measuring rules defined by QD analysis standards.

Quantity-distance (QD) analysis uses PES-ES relationship rules defined by military standards currently in use by the United States Department of Defense, Army, Navy and Air Force. These standards are implemented separately in a computer language using if-then-else or case constructs. Mathematical and logical analysis of the written standard is performed to transform the standard into an automated procedure. This process is repeated each time any one of the standards are updated. Standard validation sets associated with each version of the quantity-distance (QD) standard are maintained to ensure the automated procedure is compliant with results which have been approved. A dynamic link library (referred to as a QD Engine) incorporating the Department of Defense, Army, Navy, and Air Force criteria is included (step 22 of method 20) in the explosive safety siting method 10. The process creates a site plan table and associated drawing for each potential explosive site (PES) and its associated exposed site (ES). The site plan manager manages these plans (step 26 of method 10).

At this time it should be noted that a digital computer may be used to implement the method depicted in FIGS. 1 and 2. A computer software program may be written to analyze the data provided to locate and characterize potential explosive sites at an installation (FIG. 1), calculate an actual separation distance between each potential explosive site and an associated exposed site and also a required separation distance between each potential explosive site and their associated exposed site.

From the foregoing, it is readily apparent that the present invention comprises a new, unique, and exceedingly explosive safety siting method, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A method for determining a safe separation distance between an explosive site and an associated exposed site comprising the steps of:

(a) accessing and providing to a computing device access maps which contain installation property data for a facility, said installation property data being supplied from an installation data repository, said installation property data consisting of maps and facilities characteristics including a facility identifier, a facility description, and a facility construction category code for said facility;

(b) accessing and providing to said computing device facilities property data which includes quantity-distance analysis criteria;

(c) accessing and providing to said computing device building criteria data including building title, construction categories, building dimensions, building coordinates and building orientation;

(d) performing a spatial analysis to identify said explosive site and said associated exposed site at said facility, said spatial analysis providing an actual separation distance between said explosive site and said associated exposed site at said facility, said computing device performing said spatial analysis by processing said installation property data, said facilities property data and said building criteria data; and (e) determining a required separation distance between said explosive site and said associated exposed site to prevent damage to said associated exposed site; and (f) comparing said required separation distance to said actual separation distance to determine if said actual separation distance is greater than said required separation distance;

(g) providing a plurality of mitigation options to limit the damage to said associated exposed cite whenever said actual separation distance is greater than said required separation distance;

(h) recalculating the required separation distance between said explosive site and said associated exposed site;

(i) comparing again said required separation distance to said actual separation distance to determine if said actual separation distance is greater than said required separation distance;

(j) insuring that said actual separation distance remains greater than said required separation distance to prevent damage to said associated exposed site when an explosion occurs at said explosive site when said actual separation distance is greater than said required separation distances; and (k) providing a waiver permitting a noncompliance with a requirement that said actual separation distance remain greater than said required separation distance for a first time period of between about one year and five years; and (l) providing an exemption permitting said noncompliance with the requirement that said actual separation distance remain greater than said required separation distance for a second time period of at least five years.

2. The method of claim 1 further comprising the step of generating a site plan document which includes a table showing said explosive site and said associated exposed site, said table having a subset of properties including a net explosives weight for said explosive site, said actual separation distance between said explosive site and said associated exposed site, said required separation distance between said explosive site and said associated exposed site and a drawing depicting said explosive site relative to said associated exposed site.

3. The method of claim 1 further comprising the step of generating a plurality of engineering analysis reports which have bibliographic data comprising an explosion confinement analysis for said explosive site, a debris analysis for an explosion at said explosive site and a protection analysis to determine when said associated exposed site can withstand blast pressure and debris hazards generated by an explosion occurring at said explosive site.

4. The method of claim 1 wherein said computing means comprises a digital computer.

5. A method for determining a safe separation distance between an explosive site and an associated exposed site comprising the steps of:

(a) accessing and providing to a computing device access maps which contain installation property data for a facility, said installation property data being supplied from an installation data repository, said installation property data consisting of maps and facilities characteristics including a facility identifier, a facility description, and a facility construction category code for said facility;

(b) accessing and providing to said computing device facilities property data which includes quantity-distance analysis criteria;

(c) accessing and providing to said computing device building criteria data including building title, construction categories, building dimensions, building coordinates and building orientation;

(d) performing a spatial analysis to identify said explosive site and said associated exposed site at said facility, said spatial analysis providing an actual separation distance between said explosive site and said associated exposed site at said facility, said computing device performing said spatial analysis by processing said installation property data, said facilities property data and said building criteria data; and (e) determining a required separation distance between said explosive site and said associated exposed site to prevent damage to said associated exposed site;

(f) comparing said required separation distance to said actual separation distance to determine if said actual separation distance is greater than said required separation distance; and (g) providing a plurality of mitigation options to limit the damage to said associated exposed cite whenever said actual separation distance is greater than said required separation distance, said mitigation options including a first option to reduce explosive material storage capacity at said explosive cite and a second option to develope a mitigation project at said explosive cite;

(h) recalculating the required separation distance between said explosive site and said associated exposed site;

(i) comparing again said required separation distance to said actual separation distance to determine if said actual separation distance is greater than said required separation distance;

(j) insuring that said actual separation distance remains greater than said required separation distance to prevent damage to said associated exposed site when an explosion occurs at said explosive site when said actual separation distance is greater than said required separation distance; and (k) providing a waiver permitting a noncompliance with a requirement that said actual separation distance remain greater than said required separation distance for a first time period of between about one year and five years; and (l) providing an exemption permitting said noncompliance with the requirement that said actual separation distance remain greater than said required separation distance for a second time period of at least five years.

6. The method of claim 5 further comprising the step of generating a site plan document which includes a table showing said explosive site and said associated exposed site, said table having a subset of properties including a net explosives weight for said explosive site, said actual separation distance between said explosive site and said associated exposed site, said required separation distance between said explosive site and said associated exposed site and a drawing depicting said explosive site relative to said associated exposed site.

7. The method of claim 5 further comprising the step of generating a plurality of engineering analysis reports which have bibliographic data comprising an explosion confinement analysis for said explosive site, a debris analysis for an explosion at said explosive site and a protection analysis to determine when said associated exposed site can withstand blast pressure and debris hazards generated by an explosion occurring at said explosive site.

8. The method of claim 5 wherein said computing means comprises a digital computer.

* * * * *